US007971622B2

(12) United States Patent
Trionfetti

(10) Patent No.: US 7,971,622 B2
(45) Date of Patent: Jul. 5, 2011

(54) MODULAR STRUCTURE FOR TEMPORARY EXHIBITIONS

(75) Inventor: Gianni Trionfetti, Agrate Brianza (IT)

(73) Assignee: Balance Systems S.r.L., Agrate Brianza (Milano) (IT)

( * ) Notice: Subject to any disclaimer, the term of this patent is extended or adjusted under 35 U.S.C. 154(b) by 286 days.

(21) Appl. No.: 12/077,144

(22) Filed: Mar. 17, 2008

(65) Prior Publication Data

US 2008/0229689 A1 Sep. 25, 2008

(30) Foreign Application Priority Data

Mar. 19, 2007 (IT) ..... MI2007A0537

(51) Int. Cl.
*E06B 9/00* (2006.01)

(52) U.S. Cl. ..... 160/24; 160/122

(58) Field of Classification Search ..... 160/24, 160/120, 121.1, 122, 85, 322, 350, 370.22, 160/DIG. 18
See application file for complete search history.

(56) References Cited

U.S. PATENT DOCUMENTS

| | | | | | |
|---|---|---|---|---|---|
| 193,573 | A * | 7/1877 | Tripp | 160/25 |
| 376,436 | A * | 1/1888 | Harrison | 160/24 |
| 800,111 | A * | 9/1905 | James | 160/25 |
| 1,779,764 | A * | 10/1930 | Dasch | 40/553 |
| 3,355,695 | A * | 11/1967 | Overesch | 439/31 |
| 4,131,269 | A * | 12/1978 | Brattrud | 296/95.1 |
| 5,148,849 | A * | 9/1992 | Faludy | 160/67 |
| 5,197,797 | A * | 3/1993 | Jaksich | 362/219 |
| 5,427,169 | A * | 6/1995 | Saulters | 160/368.1 |
| 5,862,851 | A * | 1/1999 | Stoebich et al. | 160/121.1 |
| 6,098,692 | A * | 8/2000 | Dieckmann | 160/66 |
| 6,375,164 | B1 * | 4/2002 | Siegler et al. | 256/1 |
| 6,733,204 | B1 * | 5/2004 | Paniccia | 404/6 |
| 7,117,565 | B2 * | 10/2006 | Brutsaert | 16/386 |
| 7,178,790 | B2 * | 2/2007 | de Lorenzo | 256/59 |
| 2005/0098770 | A1 * | 5/2005 | Schell | 256/25 |
| 2006/0151123 | A1 * | 7/2006 | Chandler et al. | 160/24 |

* cited by examiner

*Primary Examiner* — David Purol
(74) *Attorney, Agent, or Firm* — R. Ruschena Patent Agency, LLC

(57) ABSTRACT

A modular structure (1) for temporary exhibitions which comprises at least one shaft component (2), at least one sheet (3) with at least one fixed end (3*a*), which is fastened to the shaft component (2) and at least one free end (3*b*) opposite the fixed end (3*a*), and a releasable fastening mechanism (11) capable of fixing the free end (3*a*) to the shaft component (2) and in which the shaft component (2), comprises a rolling device suitable for rolling the sheet (3).

7 Claims, 7 Drawing Sheets

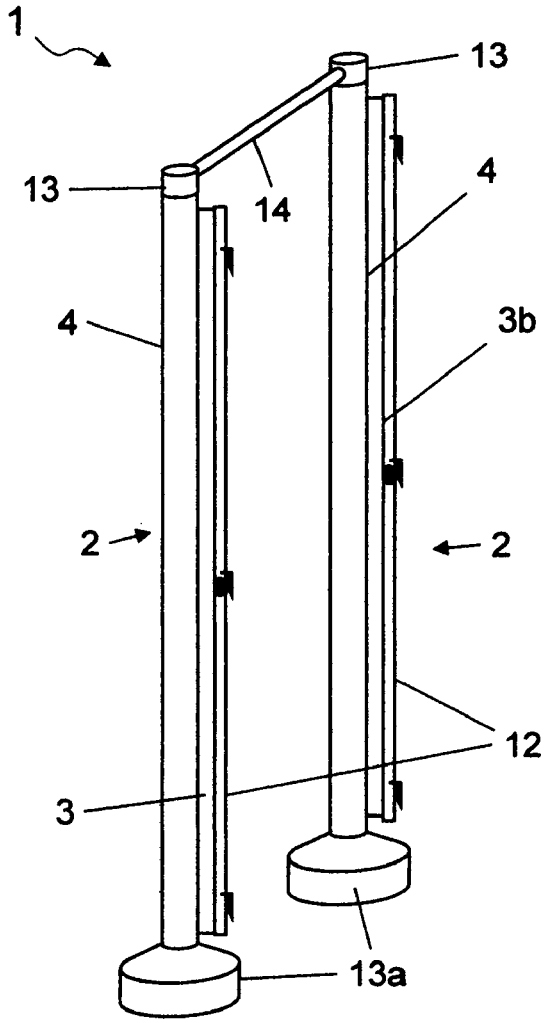
*Fig. 1*
*Fig. 2*
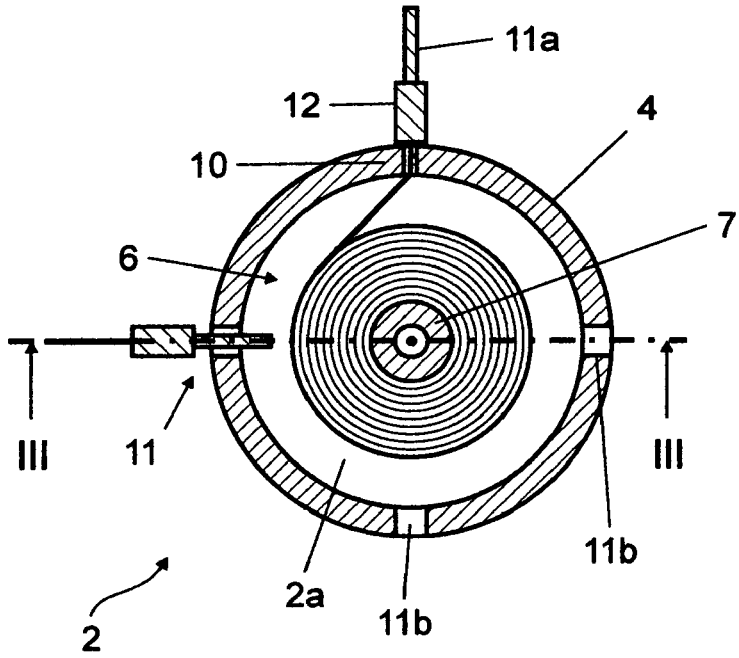

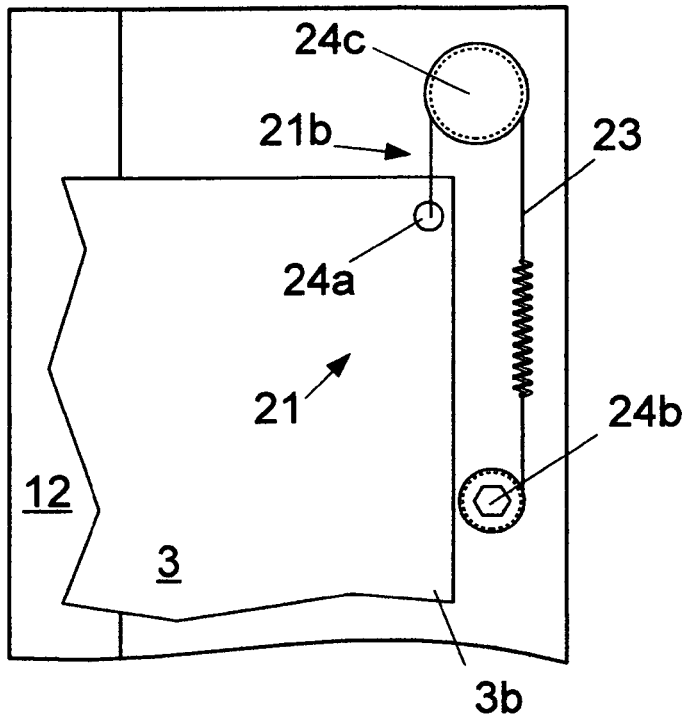
*Fig. 7a*
*Fig. 7b*
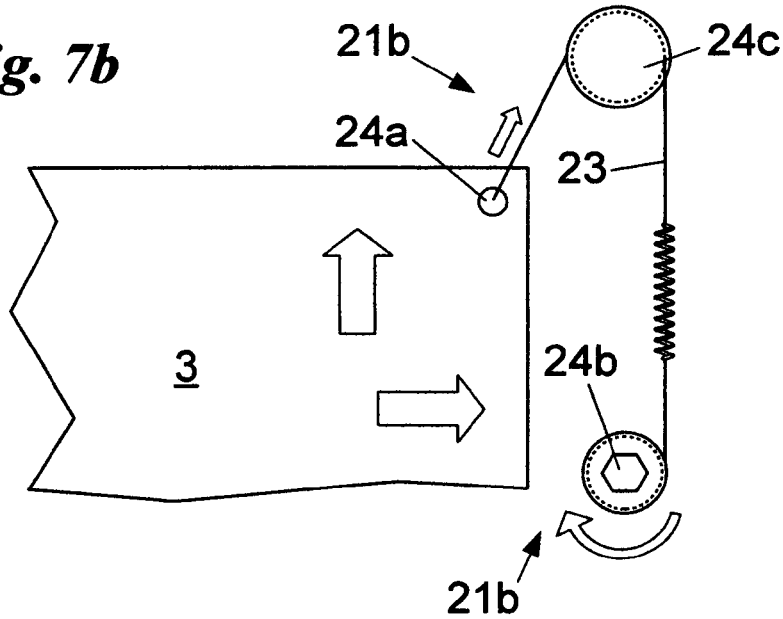

MODULAR STRUCTURE FOR TEMPORARY EXHIBITIONS

BACKGROUND OF THE INVENTION

1. Field of the Invention

This invention relates to a modular structure for temporary exhibitions of the type comprising at least one shaft component.

2. Brief Description of the Prior Art

As it is known, various structures currently exist for making stands at fairs and the like.

More specifically, various structures exist that are made of a series of modular plates that can be assembled. These plates can then be fastened to the ground through joining methods or appropriate plinths.

These components can be assembled at will to create a stand for exhibitions in fairs or for other similar temporary exhibitions. They are made from polymer materials or cardboard or something similar.

The prior art described above has some considerable drawbacks.

Assembling structures for temporary exhibitions becomes a slow and laborious process.

Another drawback arises from the fact these structures can be quite inconvenient to transport.

There are also difficulties resulting from the presence of electrical connections for lighting and the equipment displayed on the stand. It is in fact quite difficult to keep these electrical connections contained within the structures and they can constitute a hazard for people visiting or passing by the stand.

No less inconvenient is the fact that these structures are costly and have to be changed for each demonstration or fair.

SUMMARY OF THE INVENTION

In this context, the technical aim underlying this invention is to devise a modular structure for temporary exhibitions that would largely help to overcome said drawbacks.

Given this technical aim, one of the main purposes of the invention is to create a modular structure for temporary exhibitions that will be quick to assemble.

Another aim of the invention is to create a simple, cheap and versatile modular structure for temporary exhibitions.

The invention also aims to create a modular structure for temporary exhibitions that will allow electrical cables to be arranged in such a way so as not to be a hazard for visitors, passers-by and attendants.

No less important is the invention's aim to create a modular structure for temporary exhibitions that will be easy to transport.

The technical aim and the aims specified are achieved by a modular structure for temporary exhibitions as claimed in the appended claim 1.

Preferred embodiments are specified in the dependent claims.

BRIEF DESCRIPTION OF THE DRAWINGS

The accompanying drawings show by way of example preferred embodiments of the invention. In detail:

FIG. 1 shows a portion of the structure according to the invention;

FIG. 2 shows section II-II, indicated in FIG. 3;

FIG. 7*a* shows a further embodiment of FIG. 6*a;*

FIG. 7*b* shows the workings of the device in FIG. 7*a*; and

DETAILED DESCRIPTION OF THE PREFERRED EMBODIMENTS

Figure 3:
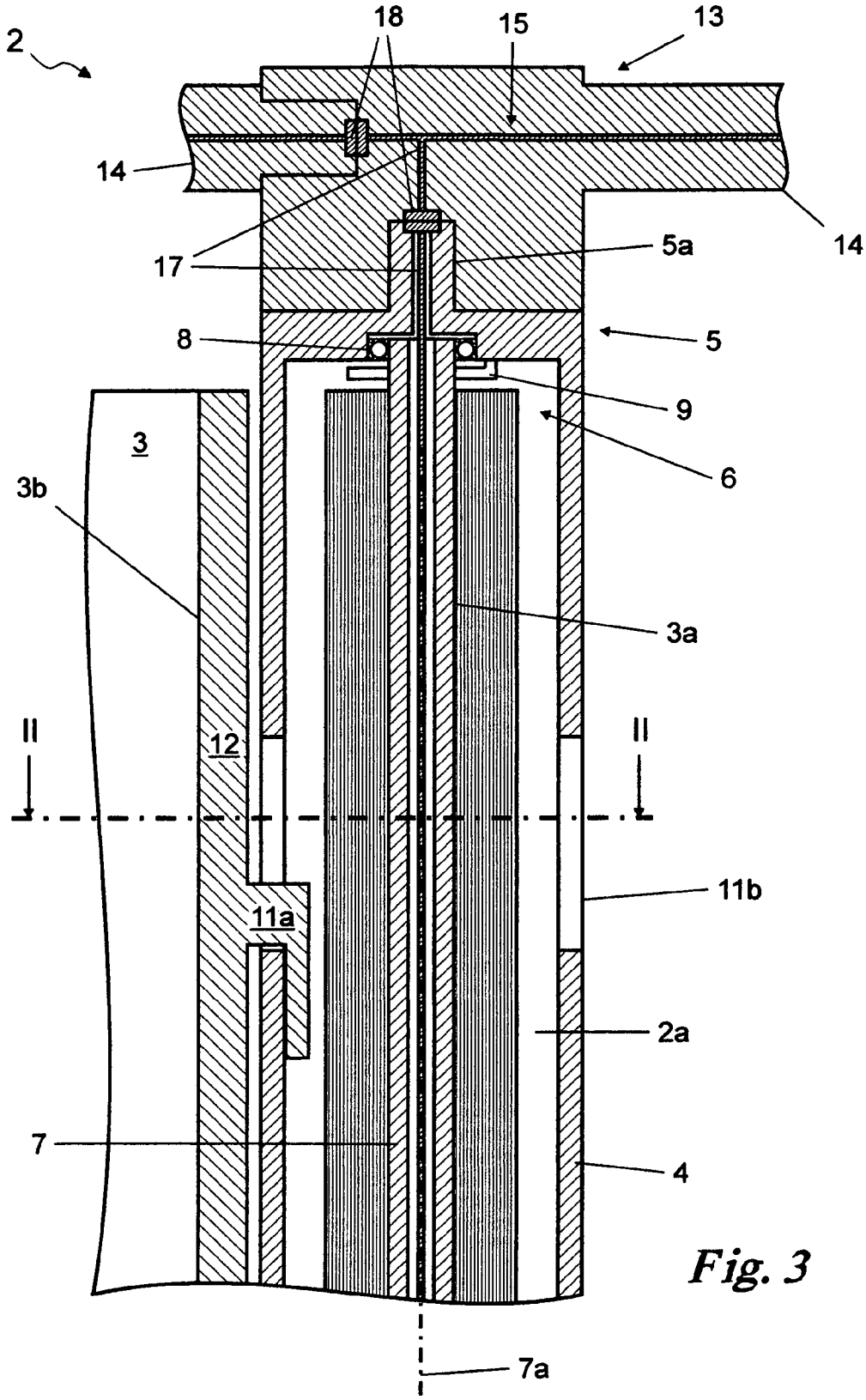
FIG. 3 shows section III-III, indicated in FIG. 2.

With reference to the Figures, the modular structure according to the invention is generally referred by number 1.

In summary, this comprises at least one shaft component 2, at least one sheet 3 with at least one fixed end 3*a*, fastened to the shaft component 2, and at least one free end 3*b* broadly opposite the fixed end 3*a*.

In particular, the shaft component 2 contains an internal cavity 2*a* and is in effect a hollow prismatic strip 4, preferably shaped as a cylinder or quadrangle, with diameter between 5 and 25 cm and with wall thickness of between 0.5 and 3.0 mm.

The strip 4 should be made from metal but could also be from polymer materials.

The shaft component 2 comprises two end sections 5 level with the bases of the prismatic strip 4.

The end sections 5 also comprise a joining mechanism 5*a*, which can allow the ends 5 to be joined to a finishing component 13 such as a plinth 13*a* in stone, metal or another material.

The said joining mechanism 5*a* is best made from a joint, as shown in FIG. 3.

The shaft component 2 also comprises rolling means 6 for the sheet 3.

In particular, the rolling means 6 is able to roll the sheet 3 inside of the prismatic strip 4.

To this end, the rolling means 6 is made up of a bar or central shaft 7 with an axle 7*a*, which largely coincides with the axle of the shaft component 2, to which the fixed end 3*a* of the sheet 3 is fastened.

The central shaft 7 will ideally be fastened to the end sections 5 by two rotating pivots 8 having the axle 7*a* as the rotational axle.

The rolling means 6 also comprises and elastic return mechanism 9 able to exert angular momentum on that shaft 7 in the direction in which sheet 3 rolls so as to keep sheet 3 rolled up.

The elastic return mechanism 9 is best made from a spring placed level with one or both of the ends 5.

The prismatic strip 4 also comprises a slot 10 to allow sheet 3 to pass from the inside to the outside of the strip 4

The structure 1 also comprises a releasable fastening means 11 from the free end 3*b* to the shaft component 2.

This will ideally be contained in the sheet 3 or in the shaft component 2.

In particular, it consists of a rigid slat 12 bound to the free end 3*b* comprising some hooked latches 11*a* that can be inserted into the appropriate slots 11*b* located on the prismatic strip 4 and fastened to the walls of the strip, as shown in FIG. 3.

The slat 12 also functions as a block level with slot 10. It is thicker than the width of the slot 10 and prevents sheet 3 from completely entering the prism 4.

The modular structure 1 should ideally also comprise at least one crossbeam 14.

This crossbeam 14 is able to join the finishing components 13 of two or more shaft components 2 and comprises latching means to the shaft components 2, which are also best made from a mobile fastener or something similar.

Furthermore, the crossbeam 14 can be pre-joined to at least one finishing component 13 and latch directly on to the joining mechanism 5*a* of an end section 5.

The crossbeam 14 should also be of length equal to or less than the length of the sheet 3 in the direction of the crossbeam. Consequently the sheet 3, pulls out from a shaft component 2 linked to a second shaft component 2 by means of the crossbeam 14 and can be latched on by the releasable fastener on said second shaft component 2.

The crossbeam 14 could also comprise a releasable fastener that could be linked to sheet 3.

A variety of shapes and sizes for crossbeams 14 and shaft components 2 could be imagined, and in particular some shaft components 2 could contain more than one sheet 3.

Also, every shaft component 2 contains a variety of releasable fasteners 11 which can hold in a series of membranes 3.

The structure 1 also comprises electrical connections 15 along the shaft components 2 and said crossbeams 14.

The electrical connections 15 comprise an electrical link to an outside system or to the mains and ideally one or more sockets, which can be linked up and provide electricity to lights, computers and various equipment. The sockets are best placed level with the finishing components 13, the plinths 13*a* and the like.

In particular the connections 15 comprise electrical cables 17 which it is best to place within, and along the whole length of the shaft components 2 and the crossbeams 14.

In particular, the cables 17 can be placed inside the central shaft 7 rather than bound to it.

The electrical connections also comprise some mobile connection components 18 level with the joining mechanism 5*a* and the latching mechanism.

These mobile connections 18 are made up of conductive metal joints or simple conductive metal plates connected to the electrical cables.

The structure 1 can also contain latch supports, which could for example be made up of the slots 11*b* or other components that can allow plates 20 or leaflet holders, etc to be latched on perpendicular to the shaft components 2.

The latch supports are also able to latch one end of a crossbeam 14.

FIGS. 6*a*, 6*b*, 7*a* and 7*b* demonstrate specific implementations of the rigid slat 12 and its attachment to the sheet 3.

In particular, the rigid slat 12 can be attached to the sheet 3 by elastic fastenings 21, pre-arranged in the desired numbers and preferably level with the upper and lower ends of the sheet 3 level with the free end 3*a*.

The elastic fastenings 21 serve to compensate for any possible slight irregularities in position or shape in the shaft components 2 and the sheet 3, thus keeping the sheet 3 perfectly taut and free from folds or creases on its surface.

Figure 6B:
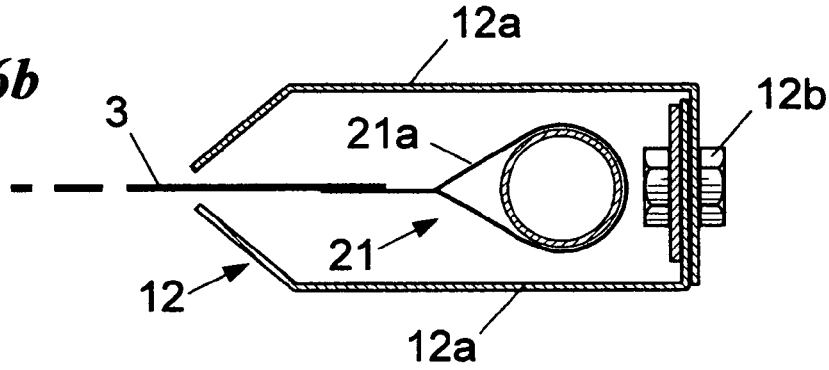
FIG. 6*b* shows a plan of FIG. 6*a;*
Figure 6A:
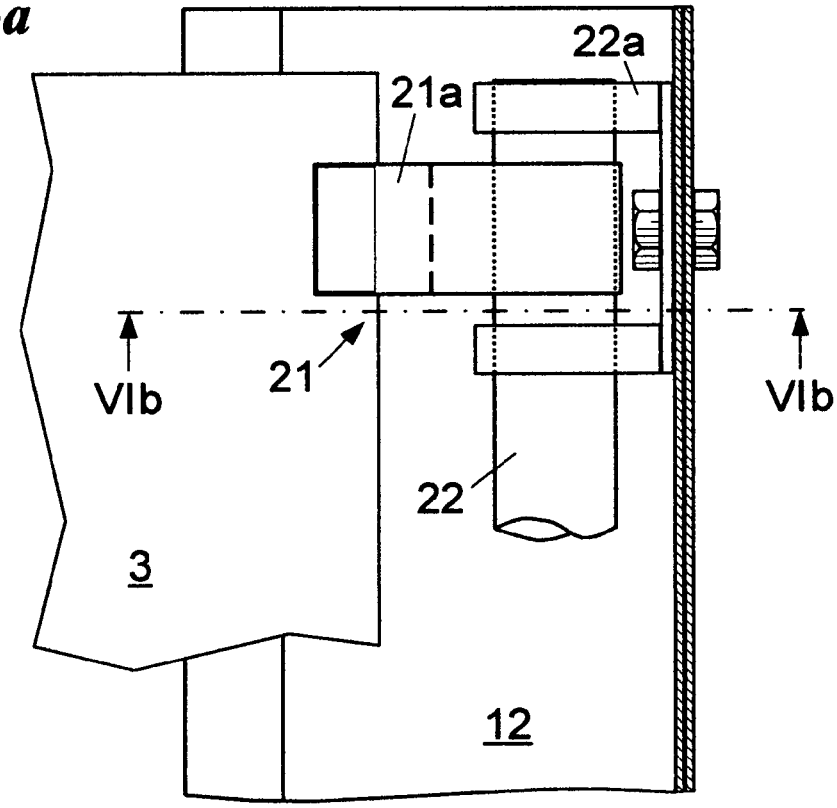
FIG. 6*a* gives a further embodiment of FIG. 3.

In FIGS. 6*a* and 6*b* the elastic fastenings 21 are made from elastic strips 21*a*, with one side glued or sewn onto the sheet 3, and the other rolled, for example using by a ring on the end, around a small bar 22 which protrudes from the rigid slat 12, held on by fastenings 22*a*.

In order to make it easy to house and assemble the elastic fastenings 21, the rigid slat 12 should preferably be in the form of a box fixed by two semi-monocoques 12*a* which can be detached by bolts 12*b*, as demonstrated in FIG. 6*b*.

FIGS. 7*a* and 7*b* demonstrate that the elastic fastenings 21 can also be made from stay-rods 21*b*.

These are made from an elastic thread 23 or, as in the diagrams, from non-elastic thread attached to a spring.

Each thread 23 is stretched between a point of attachment 24*a* located on the sheet 3 and a rolling spool 24*b* supported by the rigid slat 12 and which can be fixed as desired for example by fastening a bolt in a place chosen at the time. This allows a choice of the optimum tension to keep it stable.

Also, it is best if between the point of attachment 24*a* and the rolling spool 24*b* there is a return wheel 24*c*, which will allow the stay-rods 21*b* to be positioned in a manner that is more convenient and less of a hindrance.

In particular, the stay-rods 21*b* make it possible to make the sheet 3 either move towards the inside of the rigid slat 12, in order to avoid any localized creases, or to be moved higher or lower.

For example, it is possible to raise the sheet 3 by tightening a stay-rod 21*b* placed near the upper edge of the sheet 3, as shown in FIG. 7*b*, and at the same time slightly slackening a stay-rod 21*b* placed near the lower edge of the same sheet.

Figure 8:
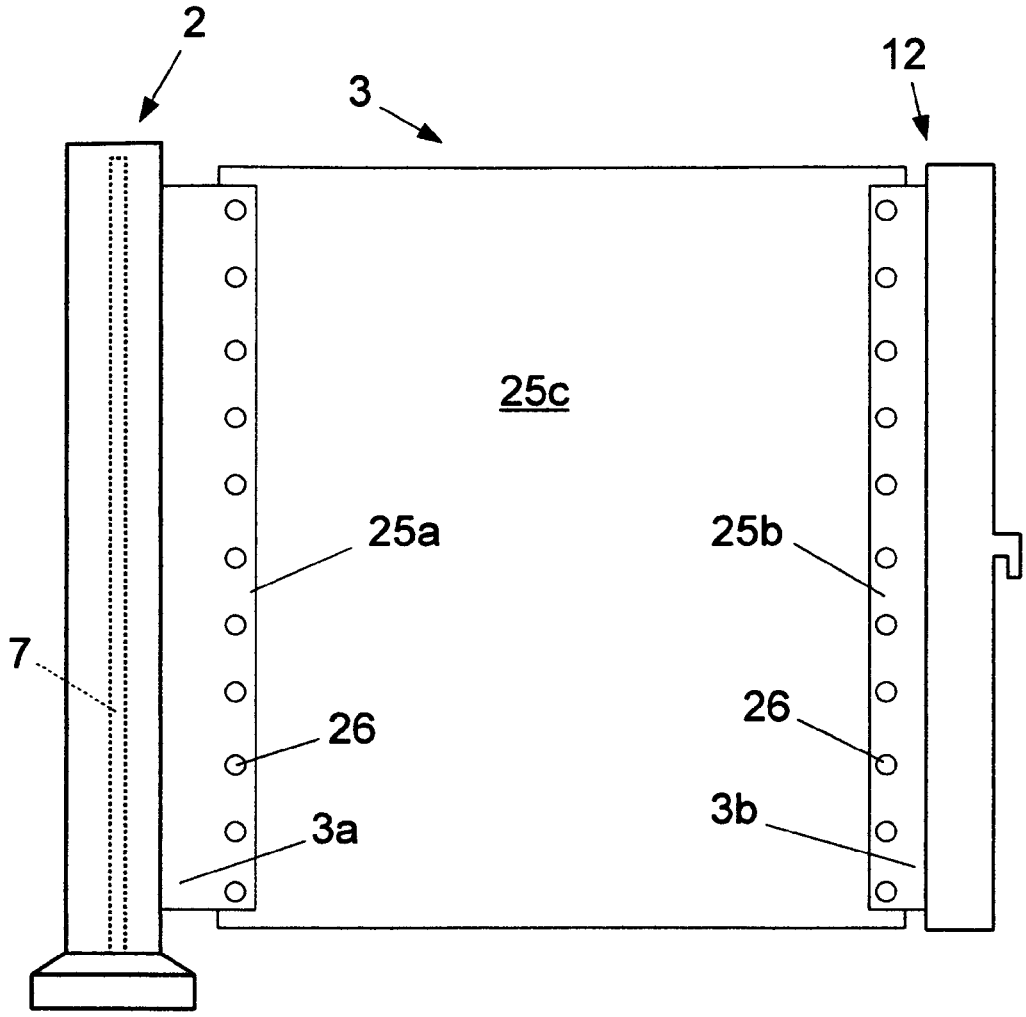
FIG. 8 demonstrates a further embodiment for the modular structure.

FIG. 8 finally shows that it is also possible to make it easy to prearrange various types of sheets 3 by dividing them into several sections that can each be moved independently.

The sheet 3 can be arranged into at least 3 parts: a first part 25*a* attached to the inside of the shaft component 2, a second part 25*b* attached to a rigid slat 12 and at least a third part 25*c* stretching between the first two and which can be detached from them.

Detaching said sections of the sheet 3 is done through by release buttons 26 or other equivalent devices, such as zips, velcro, hooks, etc.

A modular structure 1 according to this invention operates as follows.

The shaft components 2 are positioned along a suitable perimeter so as to allow the structure 1 to be assembled.

They are attached to the floor by plinths 13*a*, which can be connected to the end sections 5 or to the floor with appropriate screw-in or other types of connections and suitable end sections 13 but still connected to the shaft component 2.

The shaft components 2 are linked to one another with crossbeams 14, which make the structure 1 rigid and solid.

Figure 4:
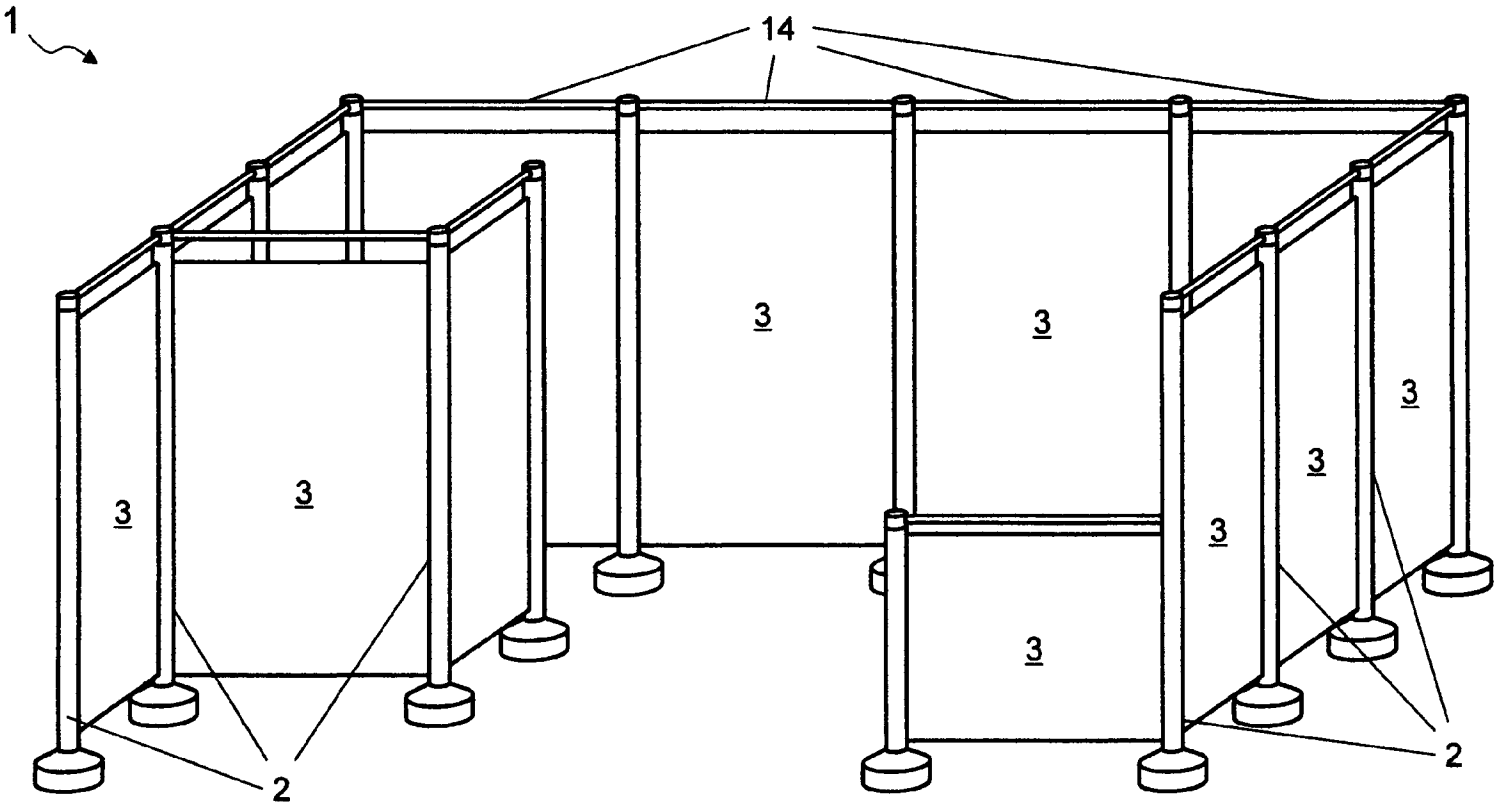
FIG. 4 sets out a plan for a temporary exhibition stand built using the structure of the invention.
Figure 5:
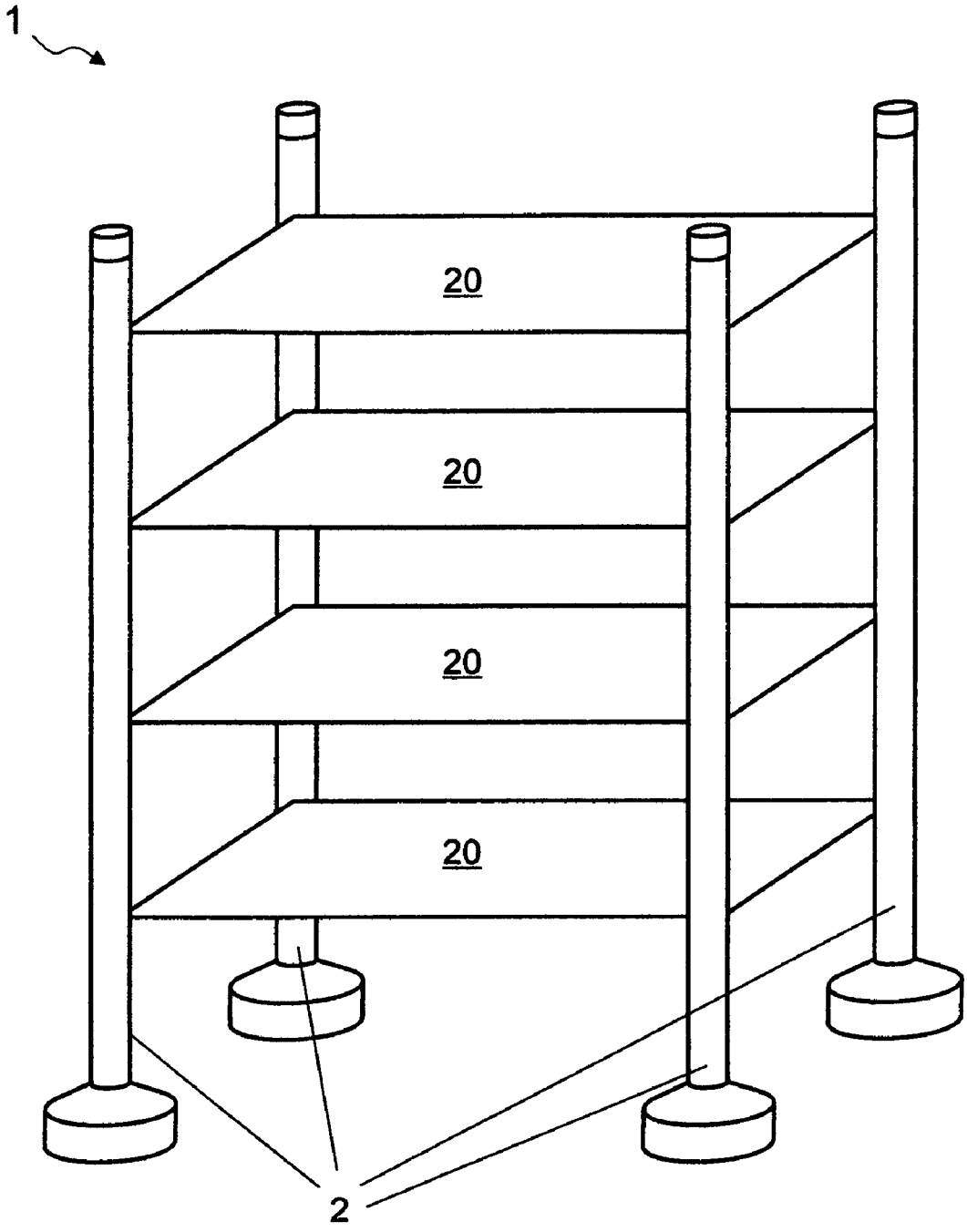
FIG. 5 shows a portion of a temporary exhibition stand built using the structure of the invention.

Then, as shown in FIG. 4 the membranes 3, positioned within the shaft components 2, are linked to an adjacent shaft component 2 by appropriate means of releasable fastening 11.

Through the steps described, and connecting only one part of the apparatus 1 with an electrical network or the like, the electrical connections 15 described above can also be created and the sockets in the structure 1 will become live. Electric lights and other equipment can therefore be linked up to them.

Appropriate plates 20 can then also be joined to the shaft components 2 to create tables or leaflet holders, amongst other things.

The invention achieves considerable advantages.

The structure 1 can be assembled quickly and with ease. It is very quick and easy to join the shaft components 2 to the crossbeams 11.

A further advantage of the structure 1 is that it is very versatile and can therefore be used for many purposes.

Another advantage of the structure 1 is that it contains its own electrical connections 15 without these constituting a hazard or creating problems in assembly.

No lesser advantage of the structure 1 is the ease with which it can be transported. It is in fact composed almost entirely of easily transportable bars.

The invention is susceptible to modifications and variants falling within the inventive concept. In particular, the electrical connections might be able to carry information, for example by using a telephone cable or internet connection, etc.

The shaft components 2 can also have removable upper expansions to increase the height of the structure.

Between the finishing components 13 fixed by the plinths 13*a*, bars can be placed through which will pass the electrical supply cables for the equipment displayed inside of the space defined by the structure according to the invention.

What I claim is:

1. A modular structure for temporary exhibitions comprising at least one shaft component (2), further comprising:

at least one sheet (3) having at least one fixed end (3*a*), fastened to said shaft component (2) and at least one free end (3*b*) substantially opposite to said fixed end (3*a*), a releasable fastening mechanism (11) that can attach said free end (3*a*) to another shaft component (2), said shaft component (2) including an internal cavity (2*a*), two end sections (5), rolling means (6) suitable for rolling said sheet (3) inside said cavity (2*a*), said shaft component (2) also comprises electrical connections (15) constituted by electrical cables (17), disposed inside the central shaft (7) and comprising electrical connections to outside systems;

said end sections (5) comprise a joining mechanism (5*a*), a finishing component (13) connected to said joining mechanism (5*a*), mobile connection components (18) are placed level with provided near said joining mechanism (5*a*) and said modular structure including at least a crossbeam (14) suitable for connecting at least two of said finishing component (13) and electrical connections (15) extending along said shaft component (2), said joining mechanism (5) and said crossbeam (14).

2. A modular structure according to claim 1, wherein said rolling means (6) comprise a central shaft (7), mounted inside of said internal cavity (2*a*); said central shaft (7) is rotatable around its axis, and it is attached to an elastic return mechanism (9) acting on said central shaft (7) so as to roll said sheet (3), said fixed end (3*a*) being attached to said central shaft (7).

3. A modular structure according to claim 1 wherein said releasable fastening mechanism (11) mounted near said free end (3*b*) comprises a rigid slat (12), attached to said sheet (3), and latches (11*a*); and wherein said shaft component (2) comprises a plurality of outside slots (11*b*) which can be attached to said latches (11*a*).

4. A modular structure according to claim 3, wherein said rigid slat (12) is attached to said sheet (3) by way of elastic fastenings (21), suitable for offsetting any irregularities of said shaft component (2).

5. A modular structure according to claim 1, wherein said electrical connections (15) comprise mobile connection components (18) which are mounted near said joining mechanism (5*a*).

6. A modular structure according to claim 1, wherein said sheet (3) is divided into independently detachable sections, said sheet (3) comprising a first section (25*a*) at said fixed end (3*a*), a second section (25*b*) at said free end (3*b*), and at least a third section (25*c*) extending between said first and second sections (25*a*, 25*b*) and releasably connected to said first and second sections (25*a*, 25*b*).

7. A modular structure according to claim 1, wherein said shaft component (2) comprises latch supports suitable for supporting a plurality of plates (20) extending perpendicularly to said shaft component (2).

* * * * *